US006293772B1

(12) United States Patent
Brown et al.

(10) Patent No.: US 6,293,772 B1
(45) Date of Patent: Sep. 25, 2001

(54) CONTAINMENT MEMBER FOR A MAGNETIC-DRIVE CENTRIFUGAL PUMP

(75) Inventors: Jeffrey S. Brown, Plainfield; Manfred P. Klein, Highland Park; Scott A. McAloon, Lombard; Peter E. Phelps, Darien, all of IL (US)

(73) Assignee: Innovative Mag-Drive, LLC, Chicago, IL (US)

( * ) Notice: Subject to any disclaimer, the term of this patent is extended or adjusted under 35 U.S.C. 154(b) by 0 days.

(21) Appl. No.: 09/428,730

(22) Filed: Oct. 28, 1999

Related U.S. Application Data

(60) Provisional application No. 60/106,103, filed on Oct. 29, 1998.

(51) Int. Cl.[7] ..... F04B 17/00

(52) U.S. Cl. ..... 417/420; 415/122.1

(58) Field of Search ..... 417/420, 370, 417/423.1, 366, 365, 368, 357; 384/110, 322; 415/122.1; 418/63; 464/29

(56) References Cited

U.S. PATENT DOCUMENTS

| | | | |
|---|---|---|---|
| 3,802,804 | 4/1974 | Zimmerman | 417/360 |
| 4,047,847 | 9/1977 | Oikawa | 417/370 |
| 4,226,574 | 10/1980 | Villette | 417/420 |
| 4,644,202 | 2/1987 | Kroy et al. | 310/58 |
| 4,645,433 | 2/1987 | Hauenstein | 417/420 |
| 4,752,194 | 6/1988 | Wienen et al. | 417/420 |
| 4,793,777 | 12/1988 | Hauenstein | 417/365 |
| 4,867,633 | 9/1989 | Gravelle | 415/106 |
| 4,869,654 | 9/1989 | Klaus | 417/360 |
| 4,890,988 | 1/1990 | Kramer et al. | 417/372 |
| 4,952,429 | 8/1990 | Schmitz | 428/34.1 |
| 4,998,863 | 3/1991 | Klaus | 417/63 |
| 5,061,151 | 10/1991 | Steiger | 415/106 |
| 5,090,944 * | 2/1992 | Kyo et al. | 464/29 |
| 5,127,792 | 7/1992 | Katsuta et al. | 415/104 |
| 5,158,440 | 10/1992 | Cooper et al. | 417/423.1 |
| 5,201,642 | 4/1993 | Hinckley | 417/420 |
| 5,615,996 | 4/1997 | Suzuki et al. | 415/1 |
| 5,641,275 | 6/1997 | Klein et al. | 417/420 |
| 5,763,973 | 6/1998 | Cramer | 310/103 |
| 5,895,203 * | 4/1999 | Klein | 415/122.1 |
| 6,135,728 * | 10/2000 | Klein et al. | 417/420 |

OTHER PUBLICATIONS

Karassik Krutzsch, Fraser, and Messina, *Pump Handbook*, 2nd. Ed., McGraw–Hill Book Company, pp. 2.53–2.59.

Robert Neumaier, *Hermetic Pumps*, Gulf Publishing, Houston, Texas, pp. 154–155; 356–359.

* cited by examiner

*Primary Examiner*—Teresa Walberg
*Assistant Examiner*—Quang Van

(57) ABSTRACT

A containment member for a magnetic-drive centrifugal pump includes a reinforcement member cooperating with an inner layer and an outer layer to form a unitary body. The inner layer has a first side defining a generally annular recess and a second side opposite the first side. The second side defines a pocket located coaxially and radially inward with respect to the annular recess. The reinforcement member has a stem portion nested within the pocket. The reinforcement member has a curved portion extending radially outward from the stem portion. The stem portion has a first radial dimension and the curved portion has a second radial dimension greater than the first radial dimension. The outer layer covers the curved portion and is affixed to the curved portion and the inner layer.

25 Claims, 8 Drawing Sheets

CONTAINMENT MEMBER FOR A MAGNETIC-DRIVE CENTRIFUGAL PUMP

This document claims the benefit of the filing date of U.S. Provisional Application No. 60/106,103, filed on Oct. 29, 1998, for any common subject matter disclosed in this document and the provisional application.

FIELD OF THE INVENTION

This invention relates to a containment member for confining fluid to a wet-end of a magnetic-drive centrifugal pump.

BACKGROUND

Magnetic-drive centrifugal pumps are well suited for pumping caustic and hazardous fluids because shaft seals are not required. Instead of shaft seals, magnetic-drive pumps generally feature a pump shaft separated from a drive shaft by a containment shell. The drive shaft is arranged to rotate with a first magnetic assembly, which is magnetically coupled to a second magnetic assembly. The second magnetic assembly applies torque to the pump shaft to pump a fluid contained within the containment shell.

The reliability of containment shells may be rated in terms a burst strength. The burst strength is a pressure per unit area from the pumped fluid on the containment shell that results in damage to the containment shell sufficient to cause the leakage of fluid from the containment shell. In general, the higher burst strength, the better the containment shell. However, increasing the burst strength of a containment shell poses some difficult technical obstacles. For example, increasing the thickness of the containment shell or adding metallic reinforcement to the containment shell may significantly degrade pump performance, making any increase in the strength of the containment shell irrelevant. If the thickness of the containment shell is too great or if metal reinforcements are used indiscriminately, magnetic coupling between the first magnetic assembly and the second magnetic assembly may be impaired. In turn, the impeller may stop rotating entirely or may rotate too slowly for proper pump performance. Thus, a need exists for a containment shell with a superior burst strength, without sacrificing the requisite efficiency of the magnetic coupling between the first magnetic assembly and the second magnetic assembly.

Many magnetically driven pumps include a front support and a rear support to support a rotating or a stationary pump shaft. The front support is often located such that the front support obstructs the inlet flow to the impeller, detrimentally limiting the performance of the pump under conditions of low net positive suction head (NPSH). Meanwhile, the rear support may be integral with a containment shell of polymer composite construction. The containment shell of the dual-support pump is often structurally inadequate to support a shaft without the assistance of a front support. Consequently, elimination of a front support for low net NPSH applications may reduce the burst strength of the containment shell, provide inadequate radial support for the pump shaft, or otherwise detrimentally impact pump reliability. Thus, a need exists for a containment shell that can support radial loads from a cantilevered shaft, while meeting a burst strength design goal.

SUMMARY OF THE INVENTION

In accordance with a preferred embodiment of the invention, a containment member for a magnetic-drive centrifugal pump includes a reinforcement member cooperating with an inner layer and an outer layer to form a unitary body. The inner layer has a first side defining a generally annular recess and a second side opposite the first side. The second side defines a pocket located coaxially and radially inward with respect to the annular recess. The reinforcement member has a stem portion nested within the pocket. The reinforcement member has a curved portion extending radially outward from the stem portion. The stem portion has a first radial dimension and the curved portion has a second radial dimension greater than the first radial dimension. The outer layer covers the curved portion and is affixed to the curved portion and the inner layer.

The containment member is well-suited for supporting a cantilevered shaft because during operation of a pump the stem portion accepts a radial load from the shaft, the stem portion transfers the radial load to the curved portion, and the curved portion distributes the radial load to the inner layer, the outer layer, or both. The curved portion may predominately distribute the radial load over adjoining surface areas defined between the first radial dimension and the second radial dimension. The resultant distribution of stress on and within the adjoining areas is compatible with the longevity and reliable service of a polymer-based construction for the inner layer and the outer layer. A polymer-based construction refers, for example, to a polymer matrix reinforced by reinforcing material distributed within the polymer matrix.

DETAILED DESCRIPTION OF PREFERRED EMBODIMENTS

Figure 1A:
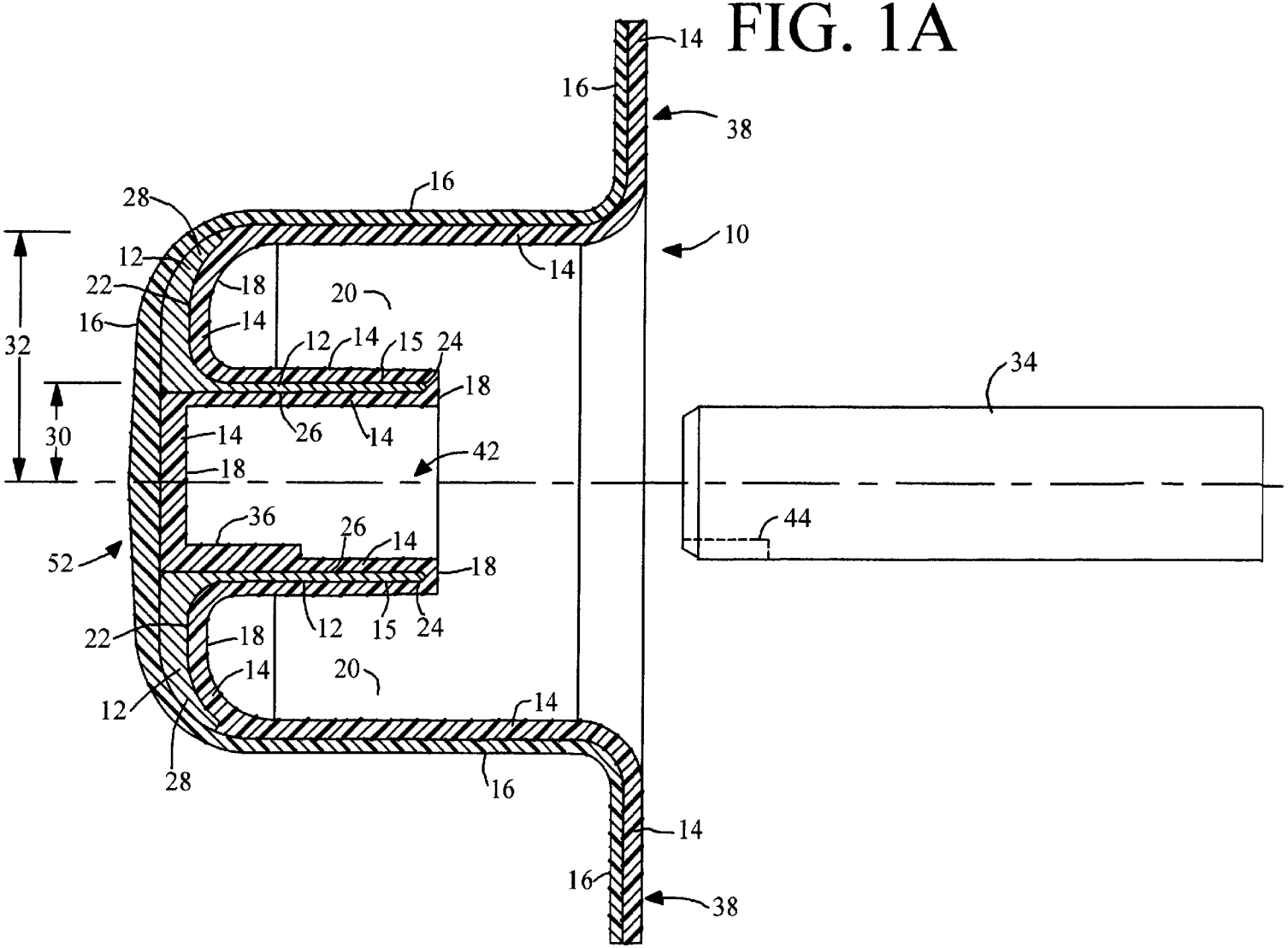
FIG. 1A shows a cross-sectional view of one embodiment of a containment member in accordance with the invention.
Figure 1B:
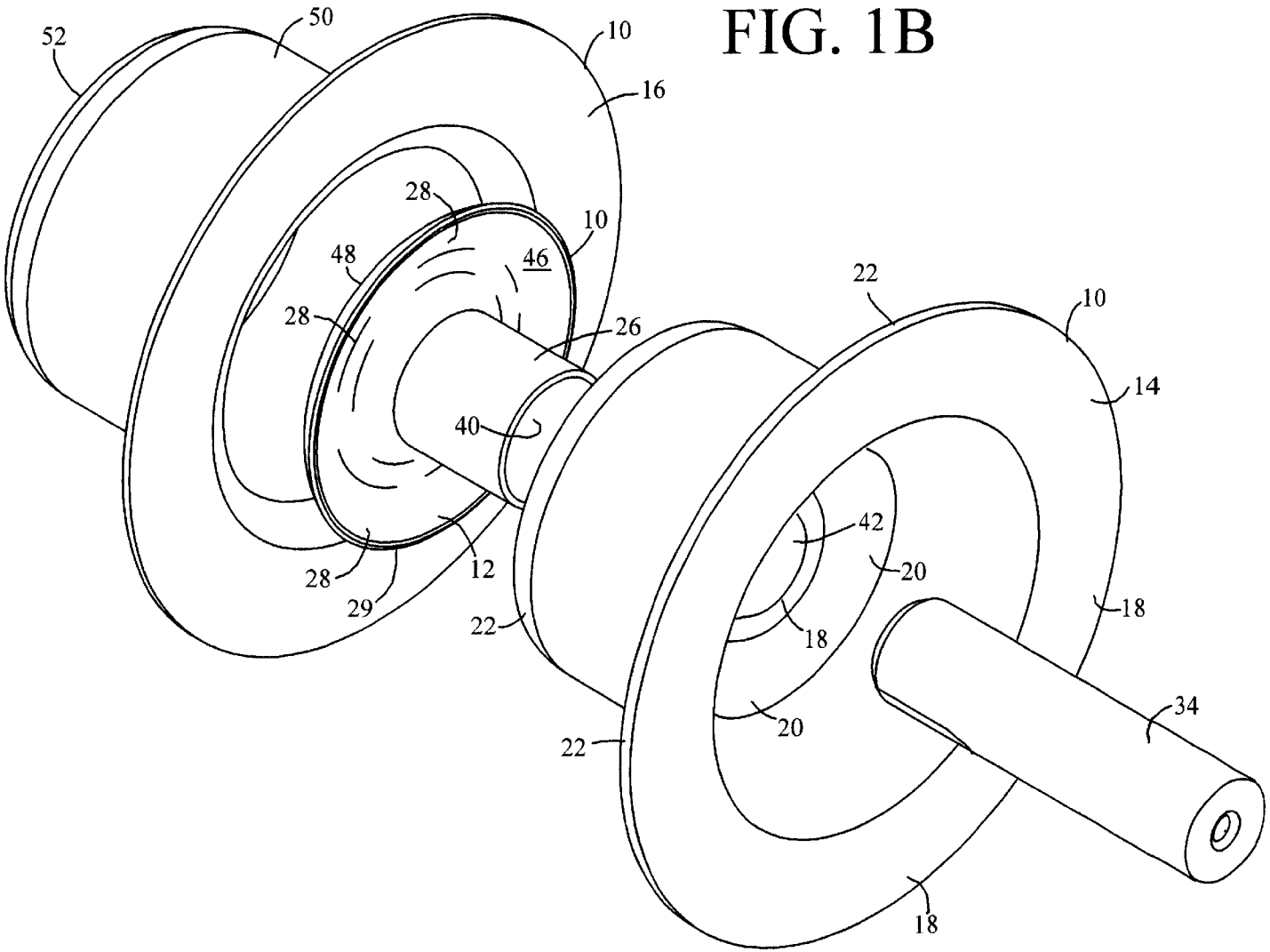
FIG. 1B shows an exploded perspective view of the containment member of FIG. 1A.

In accordance with one embodiment of the invention, FIG. 1A and FIG. 1B show a containment member 10 for a magnetic-drive centrifugal pump including an inner layer 14 adjacent to a reinforcement member 12 and an outer layer 16 affixed to the reinforcement member 12. The inner layer 14 has a first side 18 defining a generally annular recess 20. The inner layer 14 has a second side 22 opposite the first side 18. The second side 22 defines a pocket 24 located coaxially and radially inward with respect to the annular recess 20. The reinforcement member 12 has a stem portion 26 nested within the pocket 24 and a curved portion 28 extending radially outward at or near one end of the stem portion 26. The stem portion 26 has a first radial dimension 30. The curved portion 28 has a second radial dimension 32 greater than the first radial dimension 30. An outer layer 16 covers the curved portion 28 and preferably affixes the curved portion 28 to the inner layer 14 and to the reinforcement member 12 such that the inner layer 14, the reinforcement member 12, and the outer layer 16 form a unitary body of the containment member 10.

The reinforcement member 12 is generally mushroom-shaped for the receipt of radial force from a pump shaft 34 at the stem portion 26 and for the distribution of the radial force to the inner layer 14 and the outer layer 16 via the curved portion 28.

The curved portion 28 preferably has a concavo-convex cross-section such that the opposite sides of the curved portion 28 both have curved profiles. A concavo-convex cross-section refers to a concave profile on the wet-end side of the curved portion 28 and a convex profile on a dry-end side opposite the wet-end side. A curved protrusion 28 that is concavo-convex has a concave side facing the inner layer 14 and a convex side facing the outer layer 16. For example, the opposite sides of the curved portion 28 may track each other in a parallel manner and may be substantially domed or substantially hemispherical. If the curved portion 28 is substantially hemispherical, the curved portion 28 is well-suited for distributing components of a radial force from the stem portion 26 to the inner layer 14, the outer layer 16, or both.

The reinforcement member 12 has a centrally positioned bore 40 to promote adhesion between the inner layer 14 and the outer layer 16 within or in the proximity of the central bore 40. The first side 18 of the inner layer 14 has a generally cylindrical recess 42 disposed radially inward from the annular recess 20. The generally cylindrical recess 42 is adapted to receive or engage a pump shaft 34 and the annular recess 20 is adapted to receive a rotor with a radial clearance sufficient for rotation. The generally cylindrical recess 42 may have an integral key protrusion 36 that mates with a corresponding notch 44 in the pump shaft 34 to prevent the pump shaft 34 from rotating, although any other arrangement may be used to secure the pump shaft 34 to the containment member 10.

In a preferred embodiment, the stem portion 26 comprises a hollow tube having an inner diameter generally exceeding an outer diameter of the pump shaft 34 by at least a thickness of the inner layer 14. An axial length of the stem portion 26 is consistent with providing sufficient radial support for the pump shaft 34.

The reinforcement member 12 is composed of a metallic material, a metal, stainless steel, cast-iron, an alloy, or another suitable material. If the stem portion 26 is made of a corrosion-resistant metal or alloy, then a hollow cylindrical portion of the inner layer 14 between the shaft 34 and the stem portion 26 could be eliminated. The curved portion 28 or generally domed portion may have concentric radial grooves to improve adhesion to the outer layer 16, the inner layer 14, or both. The concentric radial grooves provide interlocking engagement with the polymeric matrix of the inner layer 14, the outer layer 16, or both. In an alternate embodiment, the reinforcement member 12 could feature holes in the curved portion 28 for mechanical interlocking with the polymeric matrix of the inner layer 14 or the outer layer 16.

The inner layer 14 is preferably composed of polymeric matrix and a reinforcing material distributed within the polymeric matrix. For example, the inner layer 14 may be composed of a polymer composite, a plastic composite, a fiber-reinforced plastic, a fiber-reinforced polymer, carbon fiber-filled polytetrafluoroethylene (PTFE), or another structurally suitable composition. The polymeric matrix may comprise a polymer or plastic, such as PTFE or ethylene tetrafluoroethylene (ETFE). The reinforcing material may comprise carbon fiber, ceramic, metal fiber, glass fiber, or another suitable structural-enhancing filler.

The outer layer 16 is composed of a polymer, a plastic, a polymer composite, a plastic composite, a fiber-reinforced plastic, or a fiber-reinforced polymer. The outer layer 16 may be formed by molding a composite layer over the inner layer 14 and part of the reinforcement member 12. Advantageously, the reinforcing material for the outer layer 16 may be in the structural form of fibers, particles, strands, screens, cloth, or the like. The inner layer 14 and the outer layer 16 terminate in a flange portion 38 for mounting to a pump housing.

The inner layer 14 is preferably a protective layer composed of a corrosion-resistant polymeric matrix. Suitable corrosion-resistant polymers include epoxy and vinyl ester resin. The inner layer 14 may intervene between the pump shaft 34 and the stem portion 26 to protect the stem portion 26 from attack by the pumped fluid. Similarly, if the reinforcing material within the polymeric matrix is sensitive to corrosion, a coating or sheathing of the corrosion-resistant material on the reinforcing material forms a barrier to prevent exposure of the reinforcing material to the pumped fluid. The outer layer 16 may be made of the same polymeric matrix as in the inner layer 14. However, the adhesive properties of the outer layer 16 are paramount to its corrosion-resistant properties because the outer layer 16 adhesively bonds to at least the reinforcement member 12. Further, the outer layer 16 may adhesively bond to the inner layer 14 associated with a cylindrical portion 50 and an end 52 of the containment member 10 to enhance the structural integrity of the containment member 10. Although the outer layer 16 is not intended to be exposed to pumped fluid during ordinary operation of the pump, the outer layer 16 may be a corrosion-resistant or protective layer to withstand harsh environmental conditions or unintentional exposure.

Assume that a radial force is applied to the protruding end 15 of the stem portion 26. The peak of the radial force is transmitted from the stem portion 26 to the periphery of the curved portion 28. As best shown in FIG. 1B the curved portion 28 has a first transmission surface area 46 and a second transmission surface area 48 for transmitting and distributing the radial force to the inner layer 14 and the outer layer 16, respectively. The first transmission surface area 46 is preferably a concave area having a radius varying between the first radial dimension 30 and the second radial dimension 32. The second transmission surface area 48 is preferably a convex area having a radius varying at least between the first radial dimension 30 and the second radial dimension 32. The radial forces are distributed throughout the entire region adjoining the first transmission surface 46 and the second transmission surface 48, although a peak in the radial force transmission is at the outer periphery 29 of the curved portion 28. Because the force per unit area on the containment member 10 is reduced for corresponding increases in the second radial dimension 32 of the curved portion 28, the stress tolerance of the inner layer 14 and the outer layer 16 may be optimized by maximizing radial dimensions of the containment member 10 consistent with the overall pump design. For a given second radial dimension 32 and the maximum expected radial load from the pump shaft 34, the resultant stress on the inner and outer layer (14, 16) provides a basis for selecting a structurally suitable composite material for the inner and outer layer (14, 16), aside from corrosion-resistance concerns. Structurally suitable composite materials have adequate sheer modulus and strengths for the containment member 10 along with adequate adhesive properties to promote bonding to the metallic reinforcement member 12.

The greatest force moment is produced at the periphery 29 of the curved portion 28. If the curved portion 28 is hemispherical, the periphery of the curved portion 28 defines an inner layer circumference and an outer layer circumference over which a peak stress concentration is distributed consistent with preventing delamination between the inner layer 14 and the curved portion 28 and the outer layer 16 and the curved portion 28.

The radial stress from the pumped fluid on the containment member 10 is often referred to as hoop stress. Hoop stress is normally about twice as high as the axial stress on a cylindrical portion 50 of the containment member 10. The stress on an end 52 of the containment member 10 is usually the highest of all the hydraulic stresses placed on the containment member 10. The reinforcement member 12 may be made of ductile iron, a metallic material, stainless steel, an alloy, or any metal of sufficient strength for reinforcement. The reinforcement member 12 may be turned from metal stock or formed by investment casting, for example.

A completely hemispherical shape for the curved portion 28 provides the lowest stress concentration in a composite material of the inner layer 14 and the outer layer 16, such that the greatest potential pressure rating of the containment member 10 may be realized. However, an entirely hemispherical curved portion 28 may be too axially long for certain pump designs. If the curved portion 28 is partially or generally hemispherical, as opposed to completely hemispherical, the stresses in the end 52 of the containment member 10 are nominally or tolerably increased from the aforementioned lowest stress concentration. The stem portion 26 cooperates with the curved portion 28 to provide a stress-tolerant end 52 with an integral shaft support for the shaft 34 and a containment member 10 for magnetic-drive pumps with limited axial space for a containment member 10.

The generally or entirely hemispherical shape for the curved portion 28 provides the greatest amount of surface area in a limited amount of space. The generally or entirely hemispherical dome reduces the stress on the composite material (e.g., outer layer 16) encapsulating the curved portion 28. Under tests, a containment shell consistent with the design of FIG. 1A and FIG. 1B withstood pressures of up to 2700 pounds per square inch (psi).

Figure 2:
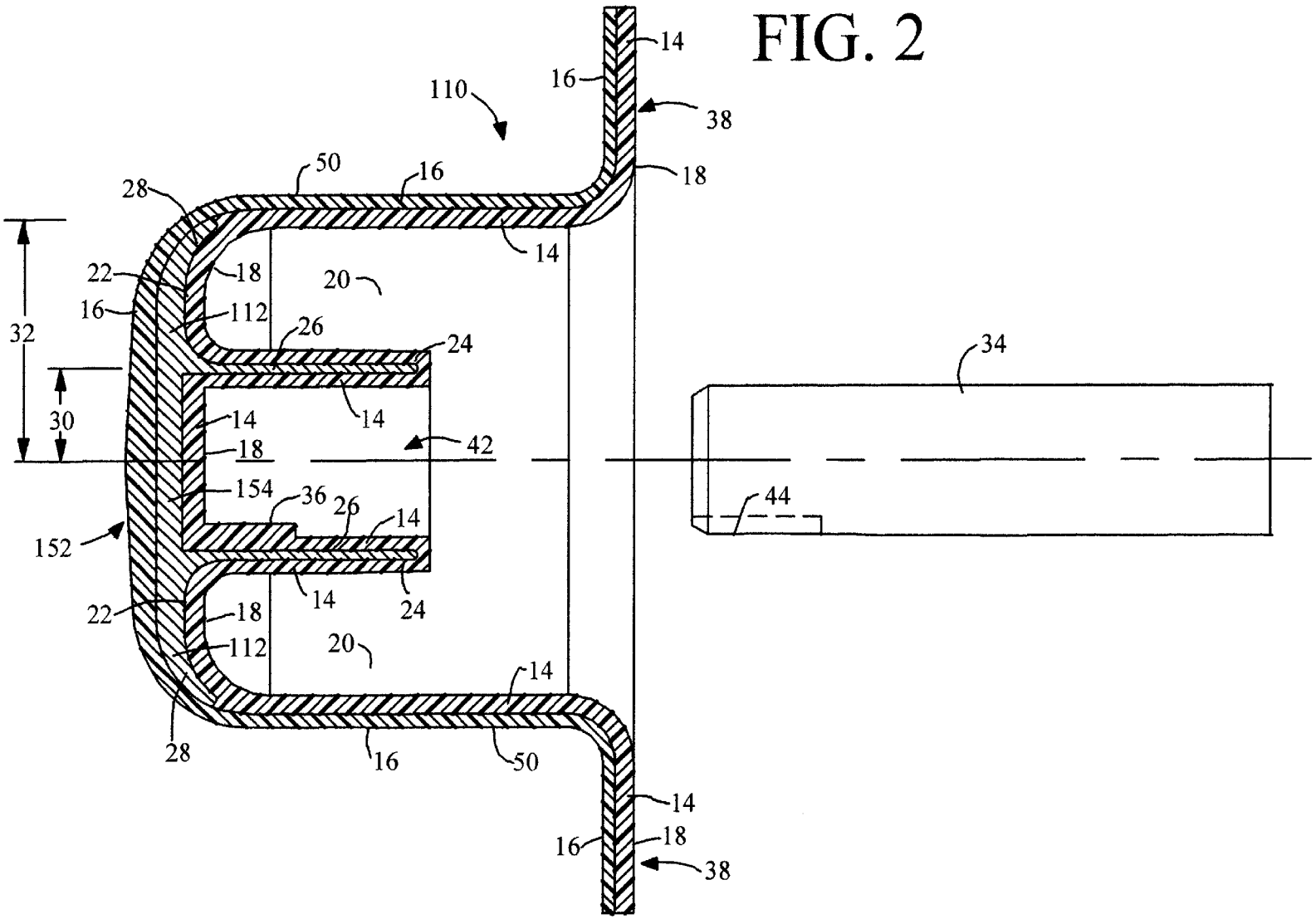
FIG. 2 through FIG. 6 show cross-sectional views of various embodiments of a containment member in accordance with the invention.

FIG. 2 shows a containment member 110 which is similar to the containment member 10 of FIG. 1A and FIG. 1B except FIG. 2 has a reinforcement member 112 with a solid central region 154 instead of the central bore 40 (FIG. 1B). Like reference numerals indicate like elements in FIG. 1A, FIG. 1B, and FIG. 2. In an end 152 of the containment member 110, the solid central region 154 provides a barrier between the inner layer 14 and the outer layer 16. The central region 154 provides some additional surface area of the curved surface 28 for the transfer of radial forces imparted by the pump shaft 34 to the outer layer 16. Although the containment member of FIG. 2 is shown in the context of a stationary shaft application, the containment member 110 of FIG. 2 is well-suited for providing additional strength against hydraulic forces for applications where a rotating shaft uses a product-lubricated bearing in a vicinity of the cylindrical recess 42 and the solid central region 154.

Figure 3:
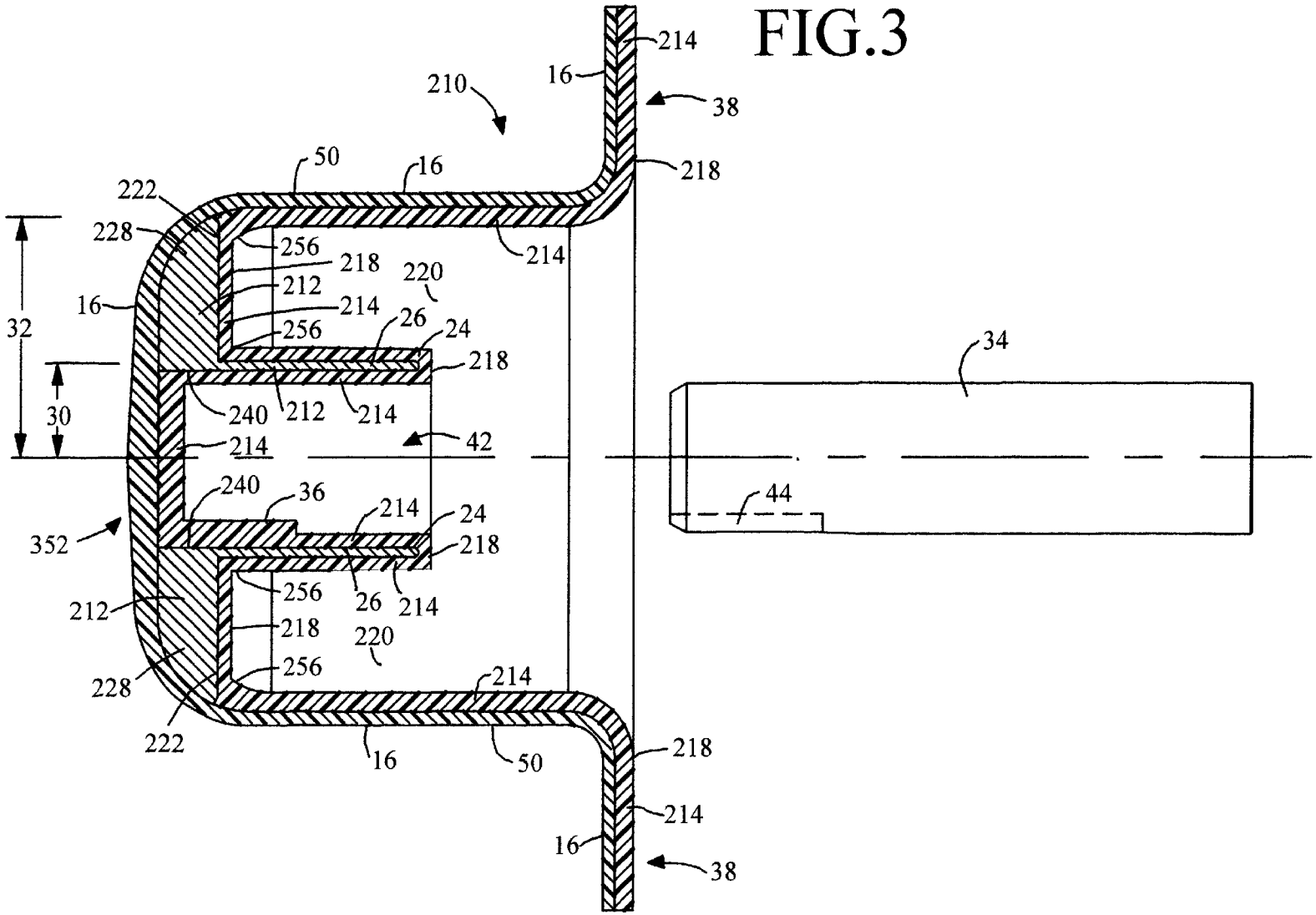

FIG. 3 shows a containment member 210 which is similar to the containment member 10 of FIG. 1A and FIG. 1B except FIG. 3 has a reinforcement member 212 in which a curved portion 228 has a generally plano-convex cross-section. An inner layer 214 of FIG. 3 provides an annular recess 220 with sharper or more orthogonal corners 256 than the annular recess 20 of FIG. 1A and FIG. 1B. The inner layer 214 has a first side 218 and a second side 222. Like reference numerals indicate like elements in FIG. 1A and FIG. 1B and FIG. 3.

A plano-convex cross section refers to a reinforcement member 212 with a generally convex side facing a dry-end of the containment member 210 and a generally planar side facing the wet-end of the containment member 210. The planar side faces and adjoins the inner layer 214. The convex side faces and adjoins the outer layer 16. The inner layer 214 and the outer layer 16 may adhere to one another in the vicinity of a central bore 240 in the reinforcement member 212 to increase the structural integrity of the containment member 210. The strength of the plano-convex cross section of FIG. 3 is somewhat similar to that of the concavo-convex cross-section of FIG. 1A and FIG. 1B because the concave side offers the same curved profile to the outer layer 16. The plano-convex cross-section of FIG. 3 may have an axial thickness of the reinforcement member 212 that transforms an end 252 of the containment member 210 into a stronger thick-walled pressure vessel, rather than a weaker thin-walled pressure vessel.

Figure 4:
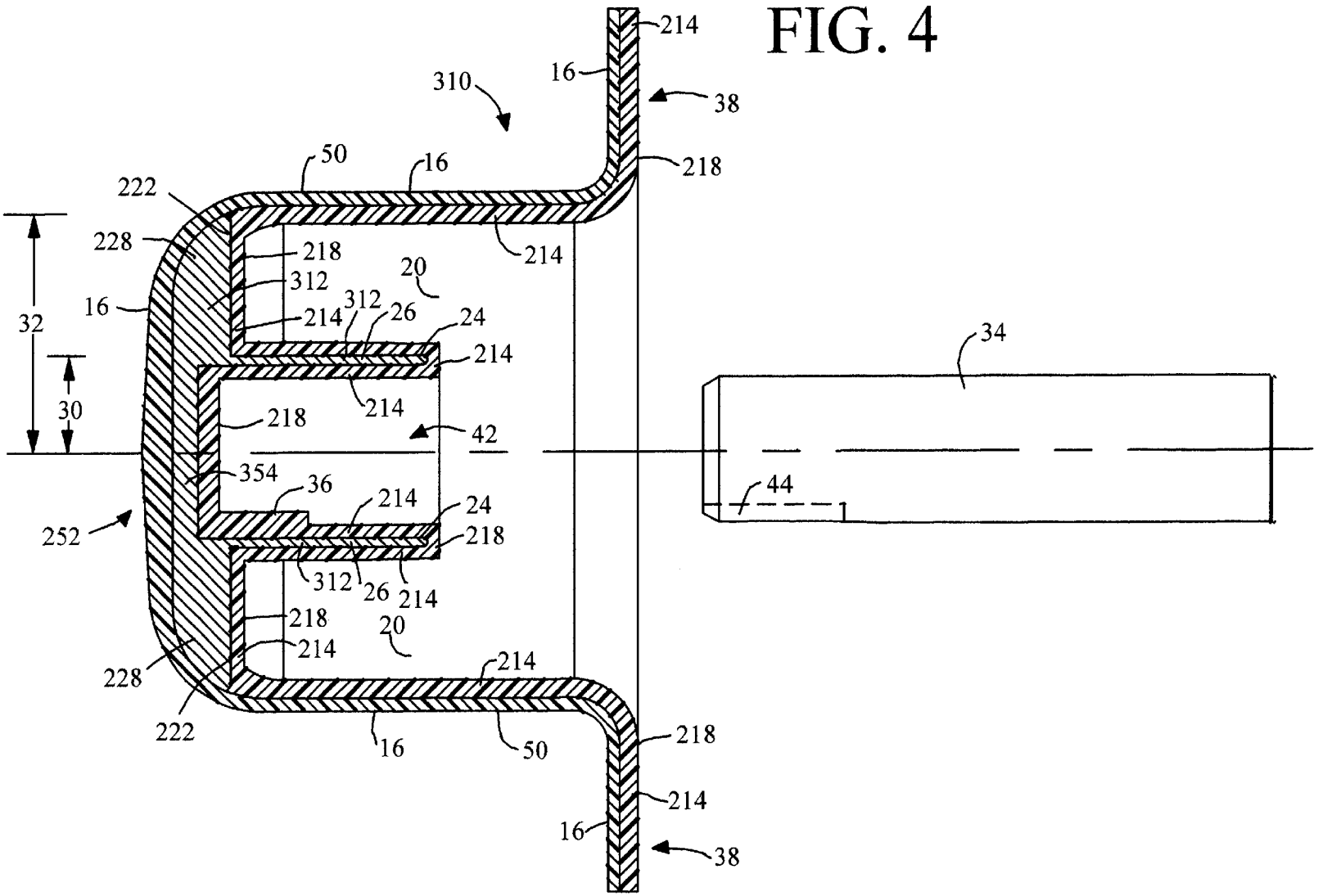

FIG. 4 shows a containment member 310 which is similar to the containment member 210 of FIG. 3 except the containment member 310 of FIG. 4 has a reinforcement member 312 with a solid central region 354 instead of a central bore 240. In an end 352 of the containment member 310, the solid central region 354 forms a barrier between the inner layer 214 and the outer layer 16. The solid central region 354 provides some additional area for the transfer of radial force imparted by the pump shaft 34 to the outer layer 16. Like reference numerals indicate like elements in FIG. 3 and FIG. 4.

Figure 5:
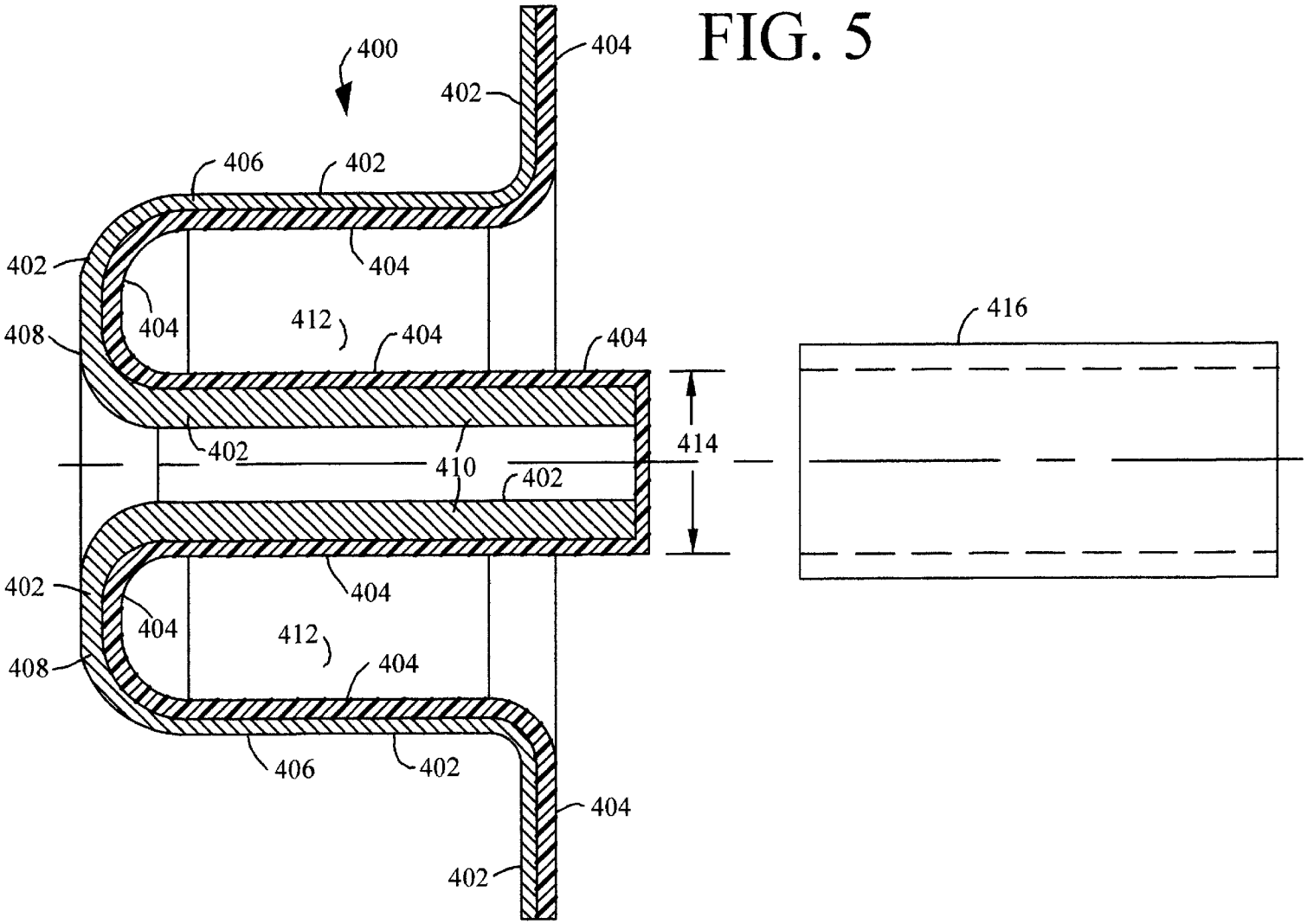

FIG. 5 shows an alternate embodiment of a containment member 400 that includes a first layer 402 and a second layer 404. The first layer 402 is a metallic reinforcement layer. The second layer 404 is a protective layer that covers the first layer 402 on a wet-end side of the pump to protect the first layer 402 from any corrosive influence of the pumped fluid. The second layer 404 is preferably formed of a composite material, such as a fiber-reinforced polymer.

The first layer 402 includes an outer cylindrical portion 406, a curved end portion 408, and an inner cylindrical portion 410. The outer cylindrical portion 406 radially extends inward at the curved end 408 to support an inner cylindrical portion 410. The curved end portion 408 has a semi-toroidal shape. The inner cylindrical portion 410 is generally coaxially oriented with respect to the outer cylindrical portion 406. The inner cylindrical portion 410 forms a tubular support for a hollow pump shaft 416.

A generally annular recess 412 is located between the inner cylindrical portion 410 and the outer cylindrical portion 406. The annular recess 412 has an inner diameter 414 for mating with the hollow pump shaft 416. The inner diameter 414 may have a slot (not shown) for engaging an integral key or any other type of key to prevent rotation of the hollow pump shaft 414.

The curved end 408 of the first layer 402 is preferably curved in a generally hemispherical manner to provide ample resistance to hydraulic stress during anticipated operational conditions of a pump. The inner cylindrical portion 410 transfers radial forces applied to the hollow pump shaft 416 during operation of the pump to the curved end 408 of the first layer 402 and the outer cylindrical portion 402.

Advantageously, the containment member of FIG. 5 uses a two-layer construction technique to simplify manufacturing whereas the containment member of FIG. 1A and FIG.

1B uses a three-layer construction technique. However, the two-layer construction may be transformed into a three-layer construction by laying fiber sheets of reinforcing material with polymeric resin over the dry-end of the first layer 402 for additional reinforcement and structural integrity.

Figure 6:
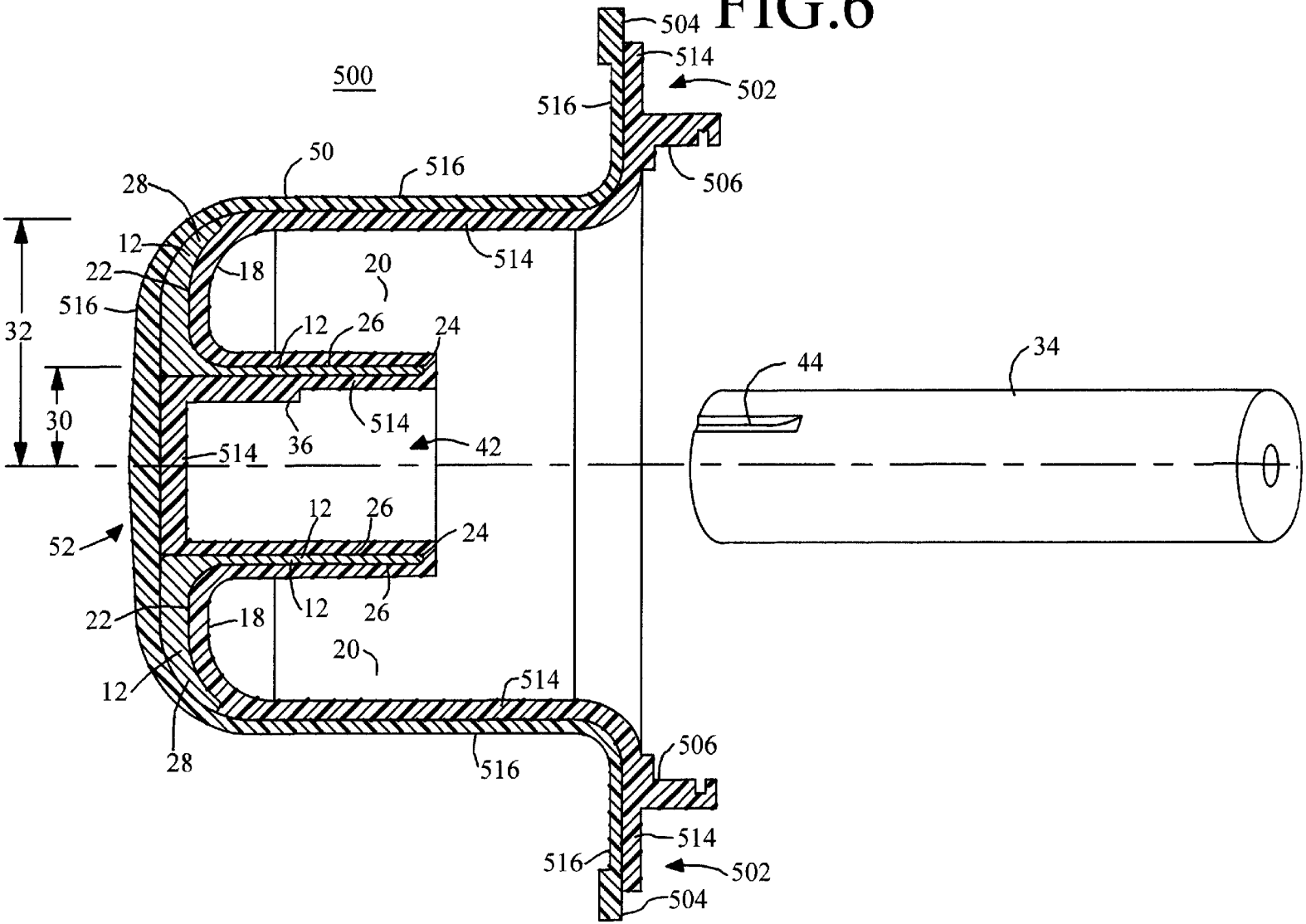
Figure 7:
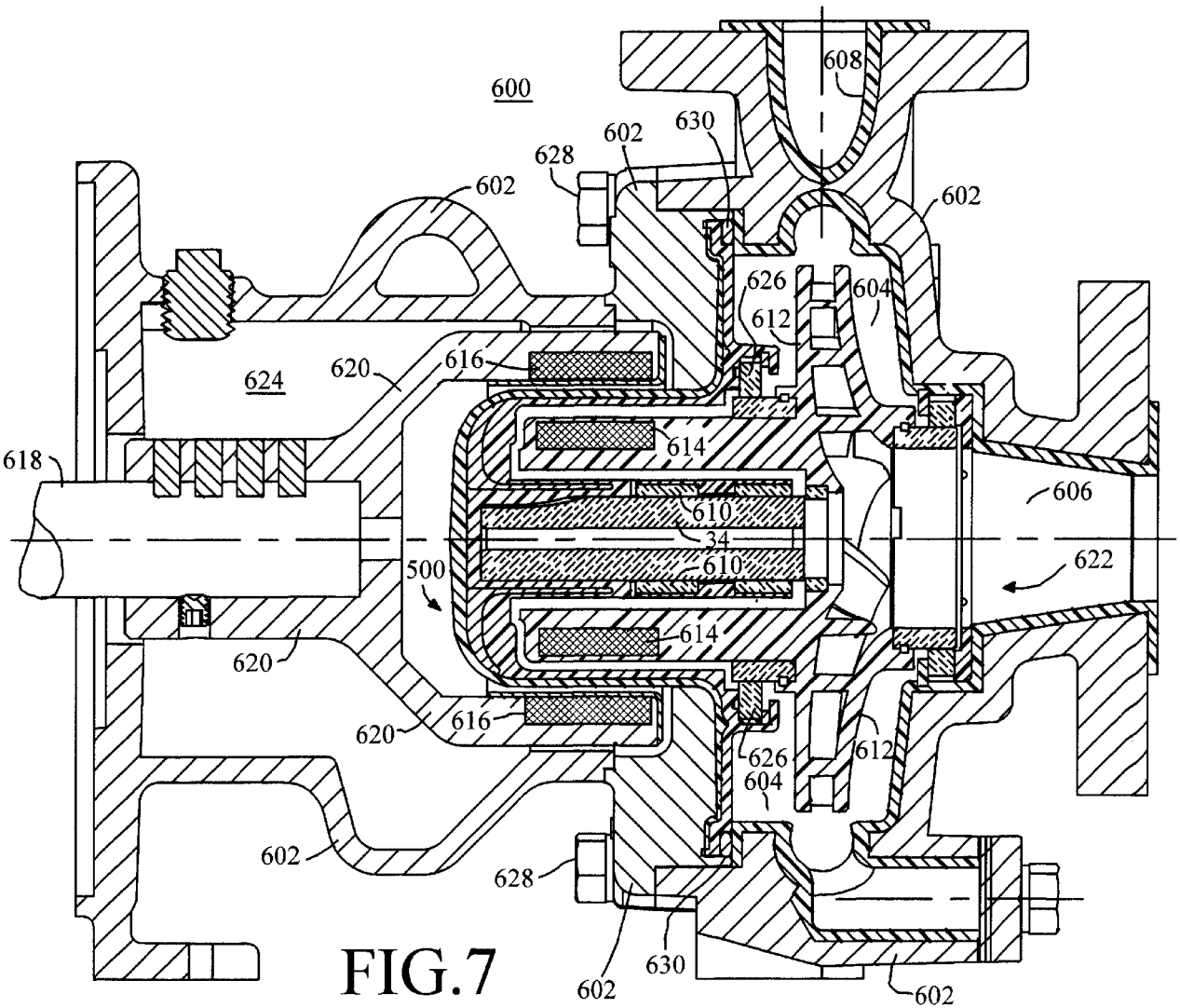
FIG. 7 shows a cross-sectional embodiment of a pump including the containment member of FIG. 6 in accordance with the invention.

FIG. 6 illustrates the containment member 10 of FIG. 1A and FIG. 1B which has been modified to include a mounting flange 502 to adapt the containment member 10 to a particular illustrative pump shown in FIG. 7. An inner layer 514 and an outer layer 516 of FIG. 6 are the same as the inner layer 14 and outer layer 16, respectively, of FIG. 1A and FIG. 1B except in the region of the mounting flange 502. Like reference numbers indicate like elements in FIG. 1A, FIG. 1B, and FIG. 6.

The mounting flange 502 of FIG. 6 includes a stepped portion 504 for receiving an elastomeric O-ring, a gasket, a seal, a sealant, or another form of sealing mechanism for confining the pumped fluid to a wet side of the containment member 500. For example, a seal 630 may be held in compression between the stepped portion 504 and a housing assembly 602 by fasteners 628 as best illustrated in FIG. 7. The mounting flange 502 of FIG. 6 further includes a support 506 for supporting a wear ring or another pump component.

In accordance with the invention, FIG. 7 shows a centrifugal pump 600 incorporating the containment member 500 of FIG. 6. Like reference numbers in FIG. 6 and FIG. 7 indicated like elements. Although FIG. 7 shows the containment member of FIG. 6, any of the containment members disclosed in the specification, including those in FIG. 1A through FIG. 6, inclusive, may be incorporated into a magnetic-drive centrifugal pump. Minor flange modifications may be required for appropriate mounting of a containment member to various centrifugal pumps and are generally known to those of ordinary skill in the art.

A centrifugal pump 600 includes a housing assembly 602 defining a pump cavity 604, an inlet 606, and an outlet 608. A shaft 34 is disposed in the pump cavity 604. A radial bearing 610 coaxially surrounds the shaft 34. The shaft 34 and the radial bearing 610 are rotatable with respect to one another. An impeller 612 is positioned to receive a fluid from the inlet 606 and to exhaust the fluid to the outlet 608.

A first magnet assembly 614 is preferably associated with the impeller 612 such that the first magnet assembly 614 and the impeller 612 rotate simultaneously. The first magnet assembly 614 may be integrated into the impeller 612 as shown in FIG. 7. A second magnet assembly 616 is preferably coaxially oriented with respect to the first magnetic assembly 614. The second magnet assembly 616 permits coupling to a drive shaft 618 through a containment member 500. The second magnetic assembly 616 is carried by a rotor 620. A drive motor (not shown) is capable of rotating the drive shaft 618 and the rotor 620.

The containment member 500 is oriented between the first magnet assembly 614 and the second magnet assembly 616. The containment member 500 is sealed to another portion of the housing 602 for confining the pumped fluid to a wet-end 622 of the pump and isolating the pumped fluid from a dry-end 624 of the pump. The containment member 500 has a socket or a generally cylindrical recess 42 for receiving the shaft 34. Although less than approximately fifty percent of the shaft length is located in the socket, in alternate embodiments any amount of the shaft length may be located in the socket.

The containment member 500 may include a support to receive a wear ring assembly 626. The practical thickness of the containment member 500 is limited to allow sufficient attraction of magnetic forces between the first magnetic assembly 614 and the second magnetic assembly 616 to allow synchronous rotation of the first magnetic assembly 614 and the second magnetic assembly 616. If the gap between the first magnetic assembly 614 and the second assembly 616 is too large, the magnetic forces will be unable to synchronously couple the torque from the drive motor to the first magnetic assembly 614. Accordingly, the impeller 612 of the pump may cease to rotate altogether or may rotate at a lower speed than desired for proper pump performance.

The use of metallic reinforcement materials may be limited to avoid adding heat to the pumped fluid which may decrease the pumping capacity of a pump. In embodiments other than that of FIG. 5, electrically conductive material is restricted from the intervening region of the containment member (e.g., 500) intervening between the first magnetic assembly 614 and the second magnetic assembly 616; particularly in the volume of the greatest magnetic flux. If metal is located in the region between the first magnetic assembly 614 and the second magnetic assembly 616, eddy electrical current may be induced in the metal from the relative rotation between the first magnetic assembly 614 and the containment member and the second magnetic assembly 616 and the containment member. The eddy currents add heat to the pumped fluid, which is readily transferred to the first magnetic assembly 614. As the temperature of the first magnetic assembly 614 increases, the coupling efficiency between the first magnetic assembly 614 and the second magnetic assembly 616 is reduced, impairing the maximum drive torque rating that may be applied to the pump.

For a detailed description of other aspects of the centrifugal pump of FIG. 7, refer to U.S. Pat. No. 6,135,728, entitled CENTRIFUGAL PUMP HAVING AN AXIAL THRUST BALANCING SYSTEM, which is hereby incorporated by reference herein.

In an alternate embodiment of the containment member, the reinforcement member may comprise a tubular member with a plug on one end. In another alternate embodiment, the reinforcement member may comprise a solid or hollow stem portion attached to a flat disk. In still another alternate embodiment, the reinforcement member has a saucer-shaped portion and a solid or hollow stem portion extending coaxially from the saucer-shaped portion. If a solid stem portion is used, a pump shaft may be hollow with a suitable inner diameter for engaging an exterior diameter of the solid stem portion including any protective sheathing thereon.

The foregoing detailed description is provided in sufficient detail to enable one of ordinary skill in the art to make and use the containment member and the associated pump of the invention. The foregoing detailed description is merely illustrative of several physical embodiments of the containment member and the pump. Physical variations of the containment member or the pump, not fully described in the specification, are encompassed within the purview of the claims. Accordingly, the narrow description of the elements in the specification should be used for general guidance rather than to unduly restrict the broader descriptions of the elements in the following claims.

We claim:

1. A containment member for a magnetic-drive centrifugal pump comprising:

an inner layer having a first side defining a generally annular recess and a second side opposite the first side, the second side defining a pocket located coaxially and radially inward with respect to the annular recess;

a reinforcement member having a stem portion nested within the pocket and a curved portion extending radially outward from the stem portion, the stem portion having a first radial dimension and the curved portion having a second radial dimension greater than the first radial dimension;

an outer layer covering the curved portion and affixing the curved portion to the inner layer such that the inner layer, the reinforcement member, and the outer layer form a unitary body.

2. The containment member according to claim 1 wherein the reinforcement member is generally mushroom-shaped for the receipt of radial force from a pump shaft at the stem portion and for the distribution of the radial force to the inner layer and the outer layer via the curved portion.

3. The containment member according to claim 1 wherein the curved portion has a generally plano-convex cross-section including a planar side facing the inner layer and a convex side facing the outer layer.

4. The containment member according to claim 1 wherein the curved portion has a concavo-convex cross-section including a concave side facing the inner layer and a convex side facing the outer layer.

5. The containment member according to claim 1 wherein the curved portion is substantially hemispherical for distributing components of a radial force from the stem portion to at least one of the inner layer and the outer layer.

6. The containment member according to claim 1 wherein the curved portion has a centrally positioned bore to promote adhesion between the inner layer and the outer layer.

7. The containment member according to claim 1 wherein the first side has a generally cylindrical recess disposed radially inward from the annular recess, the generally cylindrical recess adapted to receive a pump shaft and the annular recess adapted to receive a rotor for magnetic coupling.

8. The containment member according to claim 7 wherein the generally cylindrical recess has an integral key protrusion to prevent the pump shaft from rotating.

9. The containment member according to claim 1 wherein the stem portion comprises a hollow tube having an inner diameter generally exceeding an outer diameter of a pump shaft by at least a thickness of the inner layer.

10. The containment member according to claim 1 wherein the curved portion has a solid central region forming a barrier between the inner layer and the outer layer.

11. The containment member according to claim 1 wherein the reinforcement member is constructed from a material selected from the group consisting of a metallic material, a metal, stainless steel, cast-iron, and an alloy.

12. The containment member according to claim 1 wherein the inner layer is composed of polymeric matrix and a reinforcing material distributed within the polymeric matrix.

13. The containment member according to claim 1 wherein the inner layer is composed of a material selected from the group consisting of a polymer, a plastic, a polymer composite, a plastic composite, a fiber-reinforced plastic, and a fiber-reinforced polymer; and wherein the outer layer is composed of a material selected from the group consisting of a polymer, a plastic, a polymer composite, a plastic composite, a fiber-reinforced plastic, and a fiber-reinforced polymer.

14. A containment member for a magnetic-drive centrifugal pump comprising:

a reinforcement member having a tubular portion and a curved portion extending radially outward from one end of the tubular portion, the tubular portion having a first radius and the curved portion having a second radius greater than the first radius;

a protective layer covering at least one side of said reinforcement member to define a generally annular recess in the protective layer.

15. The containment member according to claim 14 wherein the protective layer encapsulates the reinforcement member and defines a cylindrical recess located radially and coaxially inward from the generally annular recess.

16. The containment member according to claim 14 wherein the reinforcement member is generally mushroom-shaped for the receipt of radial force from a pump shaft at the tubular portion and for the distribution of the radial force to the protective layer.

17. The containment member according to claim 14 wherein the tubular portion is located coaxially outward from the cylindrical recess to reinforce the cylindrical recess.

18. The containment member according to claim 14 wherein the curved portion has a plano-convex cross-section including a planar side facing a wet-end side of the pump and a convex side facing a dry-end side of the pump opposite the wet-end side.

19. The containment member according to claim 14 wherein the curved portion has a concavo-convex cross-section including a concave side facing a wet-end side of the pump and a convex side facing a dry-end side of the pump opposite the wet-end side.

20. The containment member according to claim 14 wherein the curved portion is substantially hemispherical for distributing components of a radial force from the tubular portion to the protective layer.

21. The containment member according to claim 14 wherein the reinforcement member has a centrally positioned bore to promote adhesion between protective layer and the reinforcement member.

22. The containment member according to claim 14 wherein the cylindrical recess accepts a pump shaft and has an integral key protrusion to prevent a pump shaft from rotating.

23. The containment member according to claim 14 wherein the annular recess has an inner diameter for mating with a hollow pump shaft.

24. The containment member according to claim 14 wherein the reinforcement member is constructed from a material selected from the group consisting of a metallic material, a metal, stainless steel, cast-iron, and an alloy.

25. The containment member according to claim 14 wherein the protective layer is composed of a polymeric matrix and reinforcing filler distributed in the polymeric matrix.

* * * * *